US010403987B2

(12) United States Patent
Otsu

(10) Patent No.: US 10,403,987 B2
(45) Date of Patent: Sep. 3, 2019

(54) PRESSURE CONTACTING CONNECTION TYPE CONTACT AND COAXIAL CONNECTOR

(71) Applicant: J.S.T. Mfg. Co., Ltd., Osaka-shi (JP)

(72) Inventor: Akihiko Otsu, Yokohama (JP)

(73) Assignee: J.S.T. MFG. CO., LTD., Osaka-shi (JP)

( * ) Notice: Subject to any disclaimer, the term of this patent is extended or adjusted under 35 U.S.C. 154(b) by 0 days.

(21) Appl. No.: 15/812,226

(22) Filed: Nov. 14, 2017

(65) Prior Publication Data

US 2018/0138604 A1 May 17, 2018

(30) Foreign Application Priority Data

Nov. 15, 2016 (JP) ..... 2016-222302

(51) Int. Cl.
*H01R 4/18* (2006.01)
*H01R 9/05* (2006.01)
*H01R 13/422* (2006.01)

(52) U.S. Cl.
CPC ..... *H01R 9/0518* (2013.01); *H01R 4/185* (2013.01); *H01R 13/422* (2013.01)

(58) Field of Classification Search
CPC ..... H01R 4/185; H01R 4/20; H01R 9/0518; H01R 2103/00; H01R 13/422
USPC ..... 439/582, 585, 877
See application file for complete search history.

(56) References Cited

U.S. PATENT DOCUMENTS 4,669,798 A * 6/1987 Daum ..... H01R 12/68 439/423
5,549,483 A * 8/1996 Hotea ..... H01R 4/185 439/399
6,565,376 B2 * 5/2003 Aoki ..... H01R 12/68 439/422

(Continued)

FOREIGN PATENT DOCUMENTS

CN 2508434 Y 8/2002
JP 2002-324636 A 11/2002
JP 2013-157113 8/2013

OTHER PUBLICATIONS

Office Action of Chinese Patent Application No. 201711119633.4 dated Feb. 3, 2019 (9 pages).

*Primary Examiner* — Gary F Paumen
(74) *Attorney, Agent, or Firm* — Kratz, Quintos & Hanson LLP

(57) ABSTRACT

To provide a pressure contacting connection type contact for reliably connecting a coaxial cable and a mating side contact. The contact is provided with a connecting terminal and a pressure contacting terminal. The connecting terminal has a pair of contact pieces, and the mating side connector can be inserted between the pair of contact pieces. The pressure contacting terminal has an extending piece and a plurality of pressure contacting pieces. The extending piece extends from a base portion. The plurality of pressure contacting pieces are alternately disposed along both sides of the extending piece separately at the extending piece, such that the central conductor can be inserted from an outer periphery. In a state wherein the central conductor is inserted between the plurality of pressure contacting pieces separately disposed at the extending piece, the plurality of pressure contacting pieces can reliable contact the central conductor.

14 Claims, 14 Drawing Sheets

(56) References Cited

U.S. PATENT DOCUMENTS

| | | | | |
|---|---|---|---|---|
| 6,739,907 | B2 * | 5/2004 | Kuroda | H01R 4/023 439/582 |
| 6,790,082 | B2 | 9/2004 | Obayashi | |
| 7,201,602 | B2 * | 4/2007 | Kumakura | H01R 12/67 439/422 |
| 7,549,868 | B1 * | 6/2009 | Ho | H01R 13/111 439/63 |
| 8,262,409 | B2 * | 9/2012 | Chang | H01R 9/0518 439/582 |
| 8,668,521 | B2 | 3/2014 | Sasaki | |
| 2001/0008816 | A1 * | 7/2001 | Ko | G01N 33/0009 439/582 |
| 2002/0187660 | A1 | 12/2002 | Obayashi | |
| 2005/0014416 | A1 * | 1/2005 | Kukita | H01R 24/44 439/582 |
| 2006/0286849 | A1 | 12/2006 | Kumakura | |
| 2008/0096420 | A1 * | 4/2008 | Zeng | H01R 9/0518 439/582 |
| 2010/0062641 | A1 * | 3/2010 | Maruyama | H01R 13/6277 439/582 |
| 2010/0068927 | A1 * | 3/2010 | Ho | H01R 9/0518 439/582 |
| 2012/0135637 | A1 | 5/2012 | Chang | |
| 2012/0164880 | A1 * | 6/2012 | Chiu | H01R 9/0518 439/582 |
| 2012/0322304 | A1 * | 12/2012 | Taguchi | H01R 13/501 439/582 |
| 2013/0149897 | A1 * | 6/2013 | Takano | H01R 12/718 439/582 |
| 2013/0196540 | A1 * | 8/2013 | Sasaki | H01R 24/38 439/582 |

* cited by examiner

PRESSURE CONTACTING CONNECTION TYPE CONTACT AND COAXIAL CONNECTOR

This application is based on and claims the benefit of priority from Japanese Patent Applications No. 2016-222302, filed on 15 Nov. 2016, the content of which is incorporated herein by reference.

BACKGROUND OF THE INVENTION

Field of the Invention

The present invention relates to a pressure contacting connection type contact, and to a coaxial connector. In particular, the present invention relates to a structure of a pressure contacting connection type contact having at a terminal portion a pressure contacting terminal which can pressure contacting connect with a central conductor of a coaxial cable, and to a structure of a coaxial connector equipped with this pressure contacting connection type contact.

Related Art

A coaxial connector fixed at a terminal of a coaxial cable, by being connected to a receptacle provided at a printed circuit board, can transmit high frequency signals from the coaxial cable to the printed circuit board, or can transmit high frequency signals from the printed circuit board to the coaxial cable.

Generally, a coaxial cable is constituted of a circular central conductor, an insulator of a fluorine-based resin or the like surrounding the circumference of the central conductor, an external conductor of a braided wire or the like surrounding the circumference of the insulator, and an insulating sheath covering and protecting the external conductor.

For example, a coaxial connector according to the prior art is provided with metallic shell and barrel-shaped external contact. Further, the coaxial connector is provided with a housing and a central contact. The shell, at one end side thereof, is fixed to the insulating sheath of the coaxial cable by crimping. The shell and the external contact are constituted as one body. The external contact is formed at one end side of the shell, and is electrically connected to the external conductor of the coaxial cable.

The housing is electrically insulated from the external contact and the central contact. The central contact is disposed at the inner portion of the external contact. The central contact is provided with a pair of leaf spring pieces with a bifurcated constitution. The central conductor of the coaxial cable is fit between the pair of leaf spring pieces and the central conductor is sandwiched by the pair of leaf spring pieces, and therefore, the central conductor and the central contact can be electrically connected.

When the coaxial connector is connected to the receptacle, the external conductor can be connected to the external contact, and the central conductor can be connected to the central contact. Thus, it is possible to transmit high frequency signals from the coaxial cable to the printed circuit board, and to transmit high frequency signals from the printed circuit board to the coaxial cable.

Incidentally, in the coaxial connector according to the prior art, the central conductor of the coaxial cable was sandwiched only by the pair of leaf spring pieces, and therefore, there was the deficiency that the connection of the central conductor of the coaxial cable and the central contact was not reliable. Thus, for example, Japanese Unexamined Patent Application, First Publication No. 2002-324636 (below referred to as Patent Document 1), discloses a coaxial connector with a more reliable connection of the central conductor of the coaxial cable and the central contact.

On the other hand, in the future, there will be demand for increasing miniaturization and slimming down of the coaxial connector as the electronic devices using the same are miniaturized and slimmed down. For example, the coaxial connector disclosed in Japanese Unexamined Patent Application, First Publication No. 2013-157113 (below referred to as Patent Document 2) lowers the mounting height to the printed circuit board, namely, it is an example of a so-called reduced height coaxial connector.

The coaxial connector in the above mentioned Patent Document 1 has a constitution wherein the central conductor of the coaxial cable is sandwiched between a fixed piece and a bending piece of the central contact, in response to the bending of a bending piece of the shell, and crimping other than the crimp barrel. In such a constitution, in the case that the central conductor is a stranded wire wherein a plurality of strands of wire are stranded, there is the concern that a plurality of strands will come loose, and the electric connection between the central conductor and the central connector will become unstable.

Further, the coaxial connector in the above mentioned Patent Document 2 has a constitution wherein the central conductor of the coaxial cable is pressed between a contact piece of the central contact via a pressing piece, and a side wall of the housing in response to bending of a bending piece of the shell, and crimping other than the crimp barrel. When the central conductor is pressed in such a position, in the same way as described above, in the case that the central conductor is a stranded wire wherein a plurality of strands of wire are stranded, there is the concern that a plurality of strands will come loose, and the electric connection between the central conductor and the central connector will become unstable.

The present invention is one which was made in consideration of such problems, and has the objective of providing a pressure contacting connection type contact and a coaxial connector wherein a connection of the central conductor of the coaxial cable and the central contact is more reliable.

SUMMARY OF THE INVENTION

The present inventors modified the structure of the central contact according to the prior art, whereby they arrived at the invention of the pressure contacting connection type contact as described below which pressure contacting connects the central conductor by a pressure contacting terminal having a plurality of pressure contacting pieces, and of the coaxial contact provided with this pressure contacting connection type contact.

The first aspect of the present invention is a pressure contacting connection type contact for electrically connecting a coaxial cable and a mating side contact, provided with a connecting terminal to which the mating side contact is connected, and a pressure contacting terminal comprising a strip-shaped extending piece which extends from a base portion side of the connecting terminal and on which a central conductor of the coaxial cable is mounted, and a plurality of pressure contacting pieces which pressure contact the central conductor, protruding from both sides of the extending piece, intermittently along the both sides.

In the pressure contacting connection type contact of the second aspect of the present invention, more preferably, the extending piece extends in a direction crossing the protrusion direction of the connecting terminal via a step portion protruding in an opposite direction of the protrusion direction of the connecting terminal from the base portion side of the connecting terminal.

In the pressure contacting connection type contact of the third aspect of the present invention, more preferably, a base portion of the connecting terminal is approximately rectangular, the connecting terminal comprises a pair of contact pieces curvilinearly protruding in an Ω-shape from both sides of the base portion, with a tip portion side opened so as to be able to receive therein the mating side contact, the extending piece extends from one side adjoining both sides of the base portion, the plurality of pressure contacting pieces of the pressure contacting terminal respectively stand from both sides of the extending piece in an opposite direction of the protrusion direction of the pair of contact pieces so as to be able to receive the central conductor from an outer periphery, and in addition to being disposed intermittently in an extension direction of the extending piece, are arranged such that a pressure contacting piece of one side of the extending piece and a pressure contacting piece of an other side of the extending piece alternated in the extension direction of the extending piece.

The pressure contacting connection type contact of the fourth aspect of the present invention more preferably further comprises a pair of protruding pieces for positioning the connecting terminal in a housing, and these protruding pieces preferably stand in an opposite direction of the protrusion direction of the pair of contact pieces, from both sides of the extending piece extending from an other side adjoining both sides of the base portion.

The fifth aspect of the present invention is a pressure contacting connection type contact for electrically connecting a coaxial cable and a mating side contact, comprising a connecting terminal having a base portion formed with an approximately rectangular shape, and a pair of contact pieces curvilinearly protruding in an Ω-shape from both sides of the base portion, with a tip portion side opened so as to be able to receive therein a mating side contact, and a pressure contacting terminal having a strip-shaped extending piece extending from one side adjoining both sides of the base portion, on which the central conductor of the coaxial cable can be mounted, and a plurality of pressure contacting pieces standing from both sides of the extending piece in an opposite direction of the protrusion direction of the pair of contact pieces and disposed so as to be able to receive the central conductor from an outer periphery, wherein the plurality of pressure contacting pieces in addition to being disposed intermittently in an extension direction of the extending piece, are arranged such that a pressure contacting piece of one side of the extending piece and a pressure contacting piece of an other side of the extending piece alternate in the extension direction of the extending piece.

The pressure contacting connection type contact of the sixth aspect of the present invention more preferably further comprises a pair of protruding pieces positioning the connecting terminal in a housing, and these protruding pieces preferably stand in an opposite direction of the protrusion direction of the pair of contact pieces, from both sides of the extending piece extending from an other side adjoining both sides of the base portion.

The coaxial connector according to the seventh aspect of the present invention constitutes a terminal of a coaxial cable having a central connector, an insulator surrounding this central conductor, an external conductor covering this insulator, and an insulating sheath covering this external conductor, comprising the pressure contacting connection type contact according to any one of the first to sixth aspects, a compound housing having a barrel-shaped portion with one face opened such that a mating side is insertable, and having a first accommodating chamber wherein the connecting terminal is disposed, and a square-shaped portion protruding from one portion of an outer periphery of the barrel-shaped portion, and having a second accommodating chamber one part of which communicates with the first accommodating chamber, and which in addition to can accommodate the pressure contacting connection type contact inserted from a protrusion direction of the connecting terminal at another face, and a conductive shell having a cylindrical-shaped shell portion which is capable of accommodating the barrel-shaped portion from a same direction as a direction of protrusion of the connecting terminal, towards one face, and a pair of extended pieces extending in an approximately parallel direction continuously from one part of the outer periphery of the cylindrical-shaped shell portion, wherein the square-shaped portion can be accommodated.

In the eighth aspect of the present invention, preferably, the square-shaped portion has a groove portion for accommodating the extending piece of the pressure contacting connection type contact communicating with the second accommodating chamber, and the groove portion comprises a plurality of recess portions provided alternately at a side wall of the groove portion facing an inner wall of the pressure contacting piece which the central conductor abuts, into which a portion of the central conductor can enter.

In the ninth aspect of the present invention, the housing preferably comprises a strip-shaped lid housing with one end side bendably joined with one portion of the barrel-shaped portion, and an other end side being able to open and close the second accommodating chamber and the groove portion, and the shell comprises a cable clamp having a base plate piece with one end side bendably joined with one portion of the cylindrical-shaped shell portion, and an other end side which interlocks with the lid housing, and which can open and close an other face of the shell.

In the tenth aspect of the present invention, the cable clamp preferably comprises a pair of conductor barrels which can crimp the external conductor, a pair of insulation grips which can crimp the insulating sheath, and a pair of crimp barrels which can crimp the square shaped portion via the pair of extended pieces.

BRIEF DESCRIPTION OF THE DRAWINGS

FIG. 4A is a plan view, FIG. 4B is a front face view, FIG. 4C is a right side face view, and FIG. 4D is a back face view.

FIG. 7A is a plan view, FIG. 7B is a front face view, FIG. 7C is a right side face view, FIG. 7D is a back face view, and FIG. 7E is a lower face view.

FIG. 10A shows a state viewed from the rear of the housing, and FIG. 10B shows the state viewed from the front of the housing.

FIG. 11A is a plan view, FIG. 11B is a front face view, FIG. 11C is a right side face view, FIG. 11D is a lower face view, and FIG. 11E is a back face view.

FIG. 13A is a plan view, FIG. 13B is a front face view, FIG. 13C is a right side face view, FIG. 13D is a back face view, and FIG. 13E is a lower face view.

DETAILED DESCRIPTION OF THE INVENTION

Below, embodiments of the invention are explained with reference to the drawings.

Constitution of the Pressure Contacting Connection Type Contact

First, the constitution of the pressure contacting connection type contact according to one embodiment of the present invention is explained.

Figure 1:
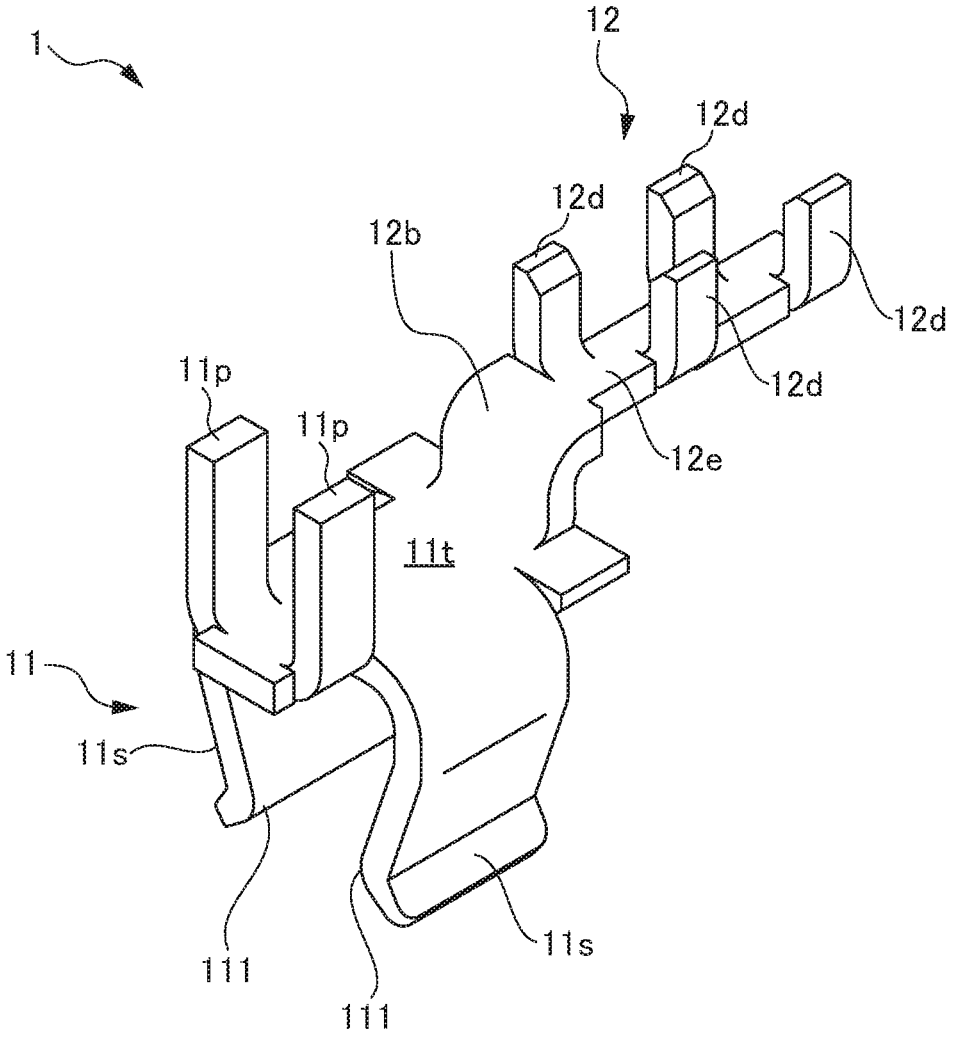
FIG. 1 is an oblique view showing a constitution of as pressure contacting connection type contact according to one embodiment of the present invention, and shows a state viewed from the front side of the pressure contacting connection type contact.

FIG. 1 is an oblique view showing the constitution of the pressure contacting connection type contact according to one embodiment of the present invention, and shows a state viewed from the front face of the pressure contacting connection type contact.

Figure 2:
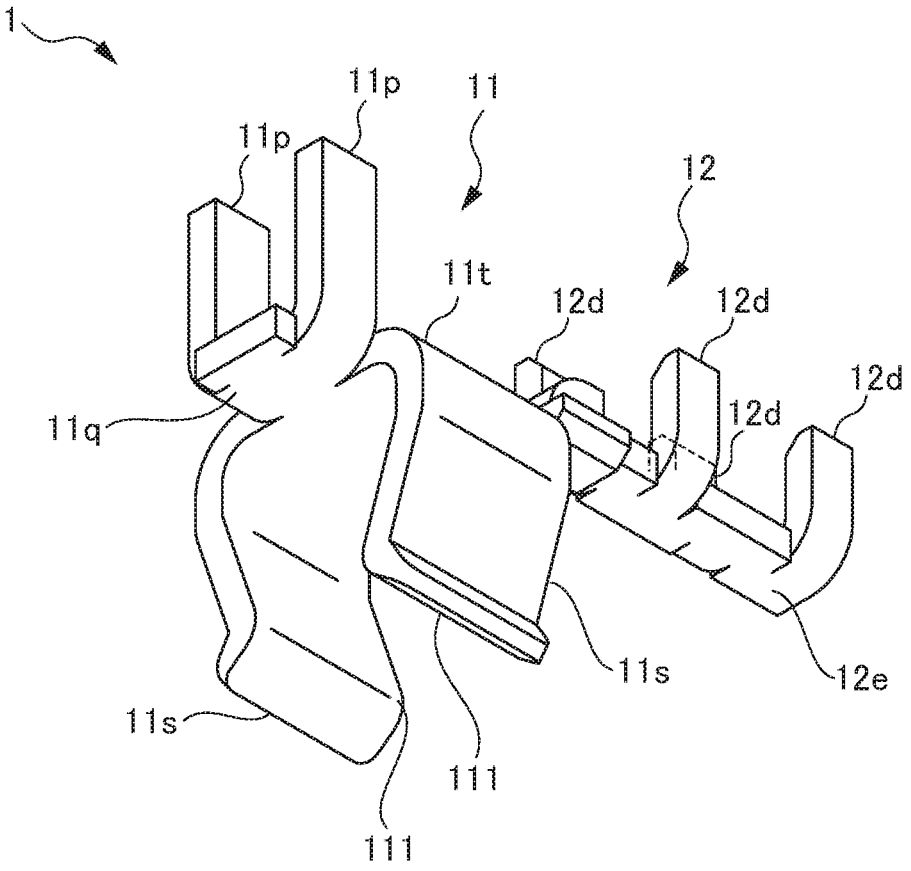
FIG. 2 is an oblique view showing the constitution of the pressure contacting connection type contact according to this embodiment, and shows a state viewed from a lower face side of the pressure contacting connection type contact.

FIG. 2 is an oblique view showing the constitution of the pressure contacting connection type contact of this embodiment, and shows a state viewed from a lower face side of the pressure contacting connection type contact.

Figure 3:
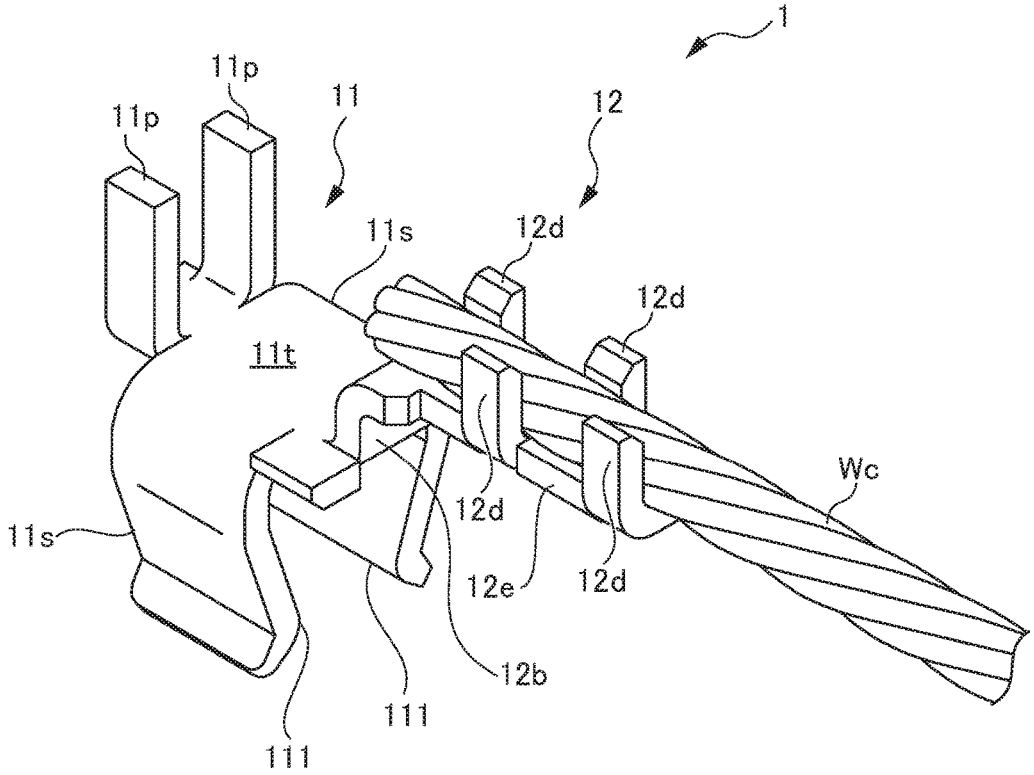
FIG. 3 is an oblique view showing the constitution of the pressure contacting connection type contact according to this embodiment, and shows a state wherein the central conductor is inserted into the pressure contacting terminal.

FIG. 3 is an oblique view showing the constitution of the pressure contacting connection type contact according to this embodiment, and shows a state wherein the central conductor is inserted into the pressure contacting terminal.

Figure 4A:
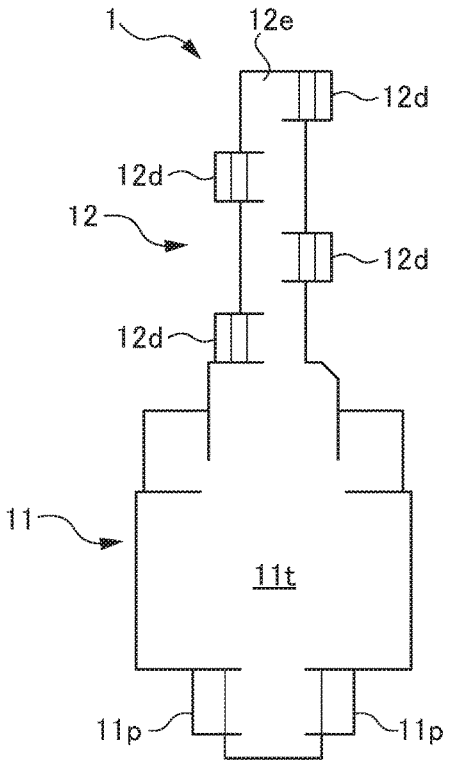
FIGS. 4A to 4D are each views showing the constitution of the pressure contacting type contact according to this embodiment.
Figure 4C:
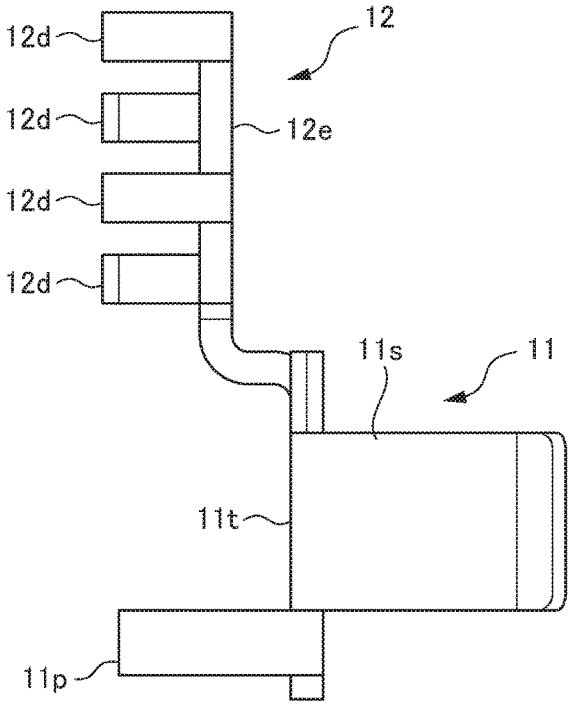
Figure 4B:
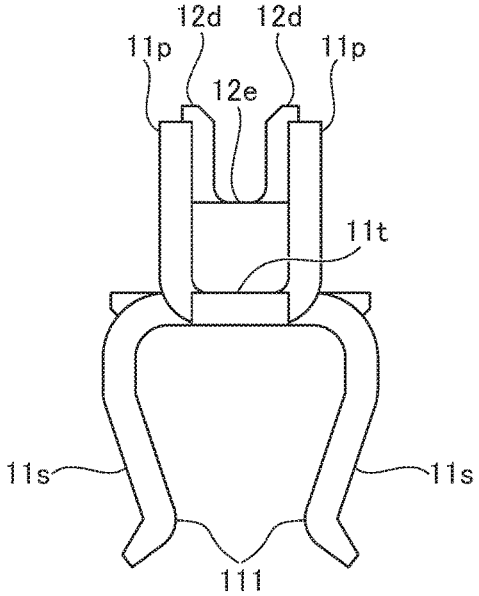
Figure 4D:
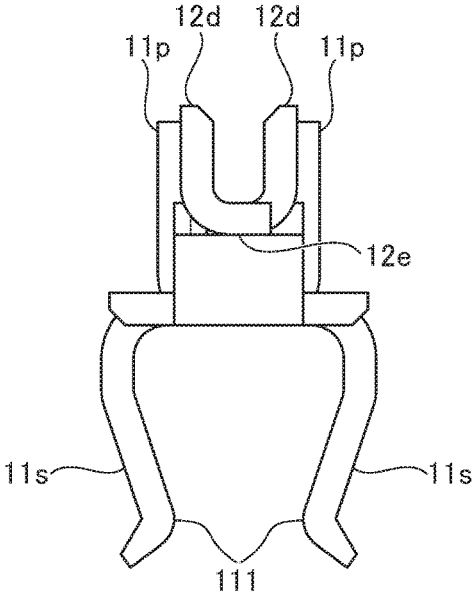

FIGS. 4A to 4D are each views showing the constitution of the pressure contacting connection type contact according to this embodiment, and FIG. 4A is a plan view, FIG. 4B is a front face view, FIG. 4C is a right side face view, and FIG. 4D is a back face view.

Referring to FIG. 1 to FIGS. 4A to 4D, the pressure contacting connection type contact (below, abbreviated as "contact") 1 according to the first embodiment of the present invention can electrically connect the coaxial cable Cb and the mating side contact, not shown in the figure.

The contact 1 is provided with the connecting terminal 11 which connects to the mating side contact, the strip-shaped extending piece 12*e* which extends from a base portion 11*t* side of this connecting terminal 11 and on which the central conductor Wc of the coaxial cable Cb is mounted, and a plurality of pressure contacting pieces 12*d* which protrude from both sides of this extending piece 12*e* intermittently along these both sides, and which pressure contact the central conductor Wc.

The base portion 11*t* of the connecting terminal 11 is formed with an approximately rectangular shape. The connecting terminal 11 has a pair of contact pieces 11*s*·11*s* which curvilinearly protrude in an Ω shape from both sides of the base portion 11*t* and with tip portions which are opened. Namely, the pair of contact pieces 11*s*·11*s* is open at the tip portion side so as to be able to receive at their inner portion the mating side contact, so that the mating side contact, not shown in the figure, can be inserted.

The pair of contact pieces 11*s*·11*s* has a pair of contact points 111·111 disposed facing each other at the tip portions of the contact pieces 11*s*·11*s*. The pair of contact points 111·111 can contact the perimeter of the mating side contact, not shown in the figures.

The extending piece 12*e* of the contact 1 extends in a direction crossing the protrusion direction of the connecting terminal 11 via a step portion 12*b* protruding in an opposite direction of the protrusion direction of the connecting terminal 11 from the base portion 11*t*, and more preferably extends in an orthogonal direction. The pressure contacting terminal 12 has four pressure contacting pieces 12*d* from the strip-shaped extending piece 12*e*. The plurality of pressure contacting pieces 12*d* stand from both sides of the extending piece 12*e*. The plurality of pressure contacting pieces 12*d* stand in an opposite direction to the protrusion direction of the pair of contact pieces 11*s*·11*s*, and are capable of receiving the central conductor Wc from an outer periphery. Further, the plurality of pressure contacting pieces 12*d* are disposed such that the central conductor Wc can be inserted from an outer periphery (refer to FIG. 3).

The plurality of pressure contacting pieces 12*d* are intermittently disposed in the direction in which the extending piece 12*e* extends. Further, the plurality of pressure contacting pieces 12*d* are arranged so that a pressure contacting piece 12*d* on one side of the extending piece 12*e* and a pressure contacting piece 12*d* on the other side of the extending piece 12*e* alternate in the direction of extension of the extending piece 12*e*, such that a pressure contacting piece 12*d* on one side of the extending piece 12*e* does not face a pressure contacting piece 12*d* on the other side of the extending piece 12*e*, but alternate in a direction of extension of the extending piece 12*e* such that are.

According to the above described constitution, the contact 1 according to the present embodiment is provided with a connecting terminal 11 having a pair of contact pieces 11*s*·11*s* inside which the mating side contact can be inserted, and a pressure contacting terminal 12 having a plurality of pressure contacting pieces 12*d* alternately arranged in the direction of extension of the extending piece 12*e* such that one pressure contacting piece 12*d* does not face another pressure contacting piece 12*d*. In this way, the plurality of pressure contacting pieces 12*d* can reliably contact the central conductor Wc in a state where the central conductor Wc is inserted between the plurality of pressure contacting pieces 12*d* separately disposed at the extending piece 12*e*.

Further, the contact 1 preferably consists of a metal plate having conductivity, and by stamp-processing the metal plate having conductivity, it is possible to obtain a pressure contacting connection type contact of the desired shape. The contact 1 preferably consists of a copper alloy, but is not limited to a copper alloy.

Operation of the Pressure Contacting Connection Type Contact

Next, the operation and effects of the contact 1 are explained while supplementing the constitution of the contact 1 according to the embodiment. Referring to FIG. 1 to FIGS. 4A to 4D, the connecting terminal 11 is further provided with a pair of protruding pieces 11*p*·11*p*. These protruding pieces 11*p*·11*p* stand from an other end side adjoining both sides of the base portion 11*t*, in an opposite direction to the protrusion direction of the pair of contact pieces 11*s*·11*s*. In more detail, the protruding pieces 11*p*·11*p* stand in an opposite direction to the protrusion direction of the pair of contact pieces 11*s*·11*s* from both sides of the extending piece 11*q* extending from another side adjoining both sides of the base portion 11*t*.

By accommodating the pair of protruding pieces 11*p*·11*p* in the second accommodation chamber 222 of the later described housing 2 (refer to FIG. 10A), the pair of protruding pieces 11*p*·11*p* can position the contact 1 in the housing 2.

With reference to FIG. 3, in the state wherein the central conductor Wc is inserted between the plurality of pressure contacting pieces 12*d* separately disposed at the extending piece 12*e*, the inner walls of the plurality of pressure contacting pieces 12*d* can contact the central conductor Wc from alternating outer peripheries of the central conductor Wc, and therefore, the central conductor Wc and the contact 1 can be reliably connected electrically without a plurality of strands of the central conductor Wc coming loose. The plurality of pressure contacting pieces 12*d* are configured to be pressure contacted against the central conductor Wc as a whole so that each inner wall portion of the pressure contacting pieces 12*d* allows contact with the outer periphery of the central conductor Wc while maintaining uprightness from the extending piece 12*e*.

Constitution of the Coaxial Connector

Figure 5:
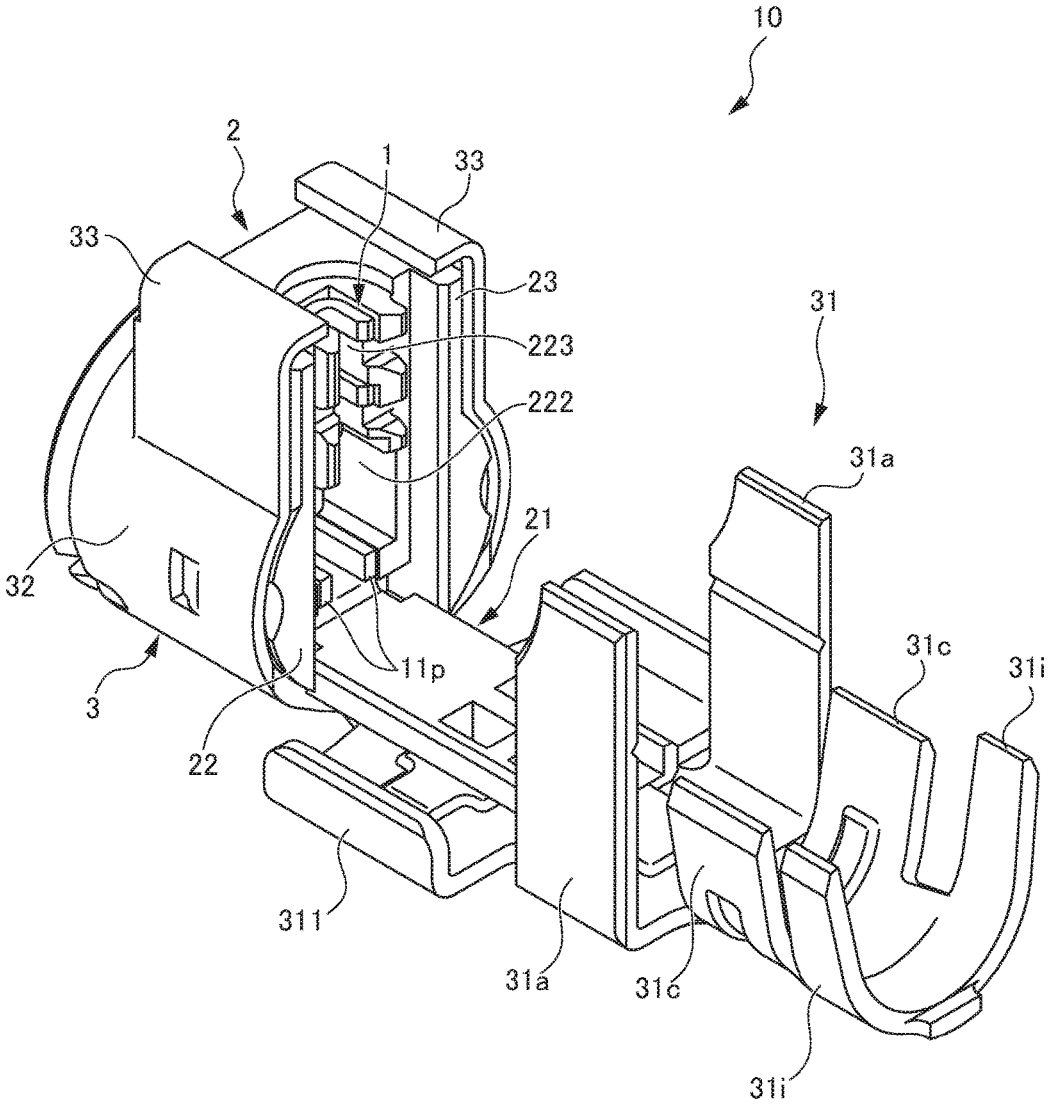
FIG. 5 is an oblique view showing the constitution of a coaxial connector according to one embodiment of the present invention, and shows a state before integrating the terminal of the coaxial cable with the coaxial connector.

Next, the constitution of the coaxial connector according to one embodiment of the present invention is explained. FIG. 5 is an oblique view showing the constitution of the coaxial connector according to one embodiment of the present invention, and shows a state before the terminal of the coaxial cable is installed in the coaxial connector.

Figure 6:
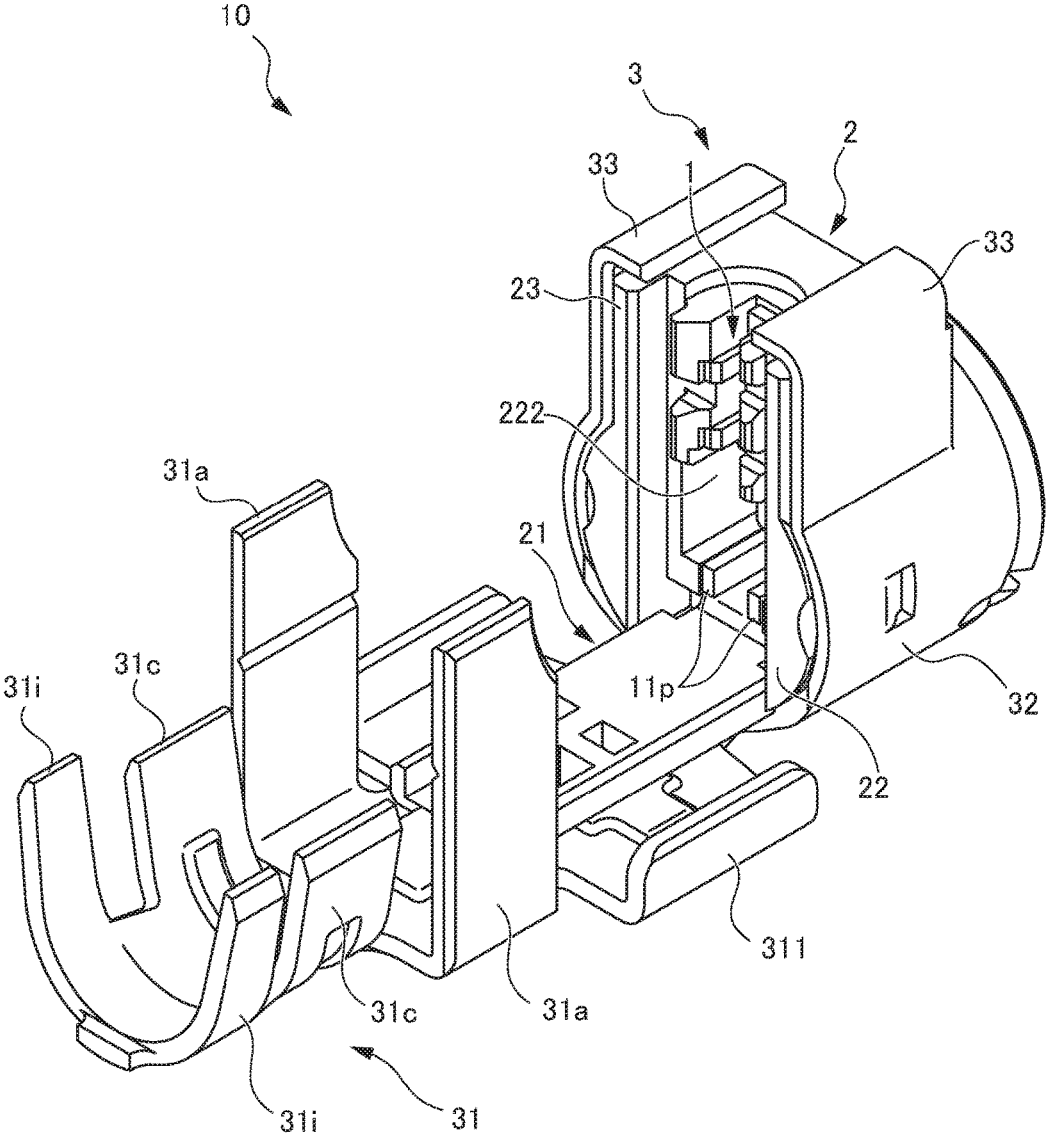
FIG. 6 is an oblique view showing the constitution of the coaxial connector according to this embodiment, and shows a state before integrating the terminal of the coaxial cable with the coaxial connector, viewed from a different direction than FIG. 5.

FIG. 6 is an oblique view showing the constitution of the coaxial connector according to this embodiment, and shows a state before the terminal of the coaxial cable is installed in the coaxial connector, viewed from a different direction than FIG. 5.

Figure 7D:
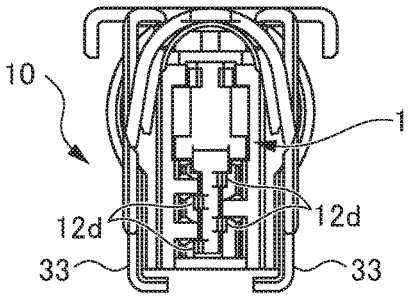
FIGS. 7A to 7E are each views showing the constitution of the coaxial connector according to this embodiment.
Figure 7E:
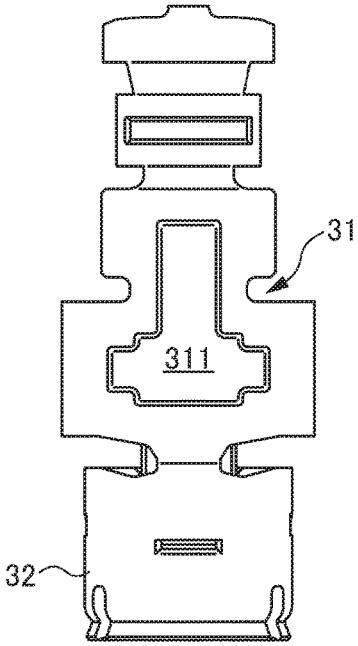
Figure 7A:
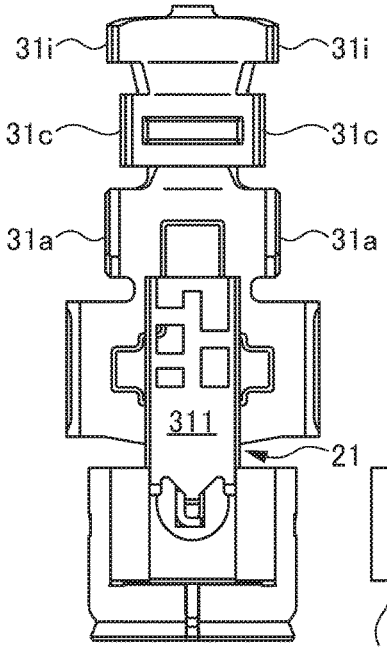
Figure 7C:
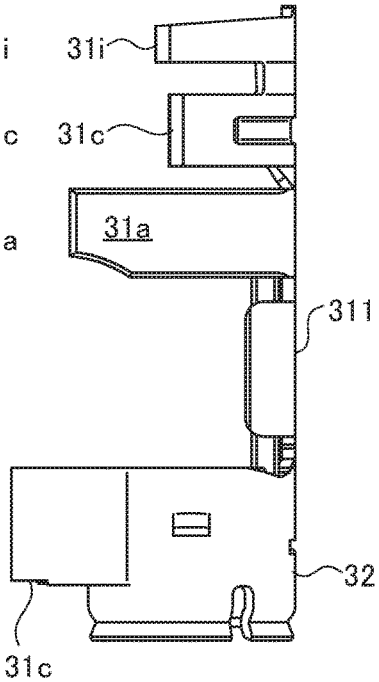
Figure 7B:
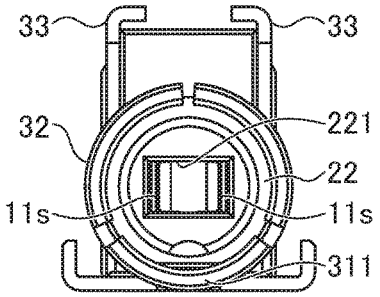

FIGS. 7A to 7E are each views showing the constitution of the coaxial connector according to this embodiment, and FIG. 7A is a plan view, FIG. 7B is a front face view, FIG. 7C is a right side face view, FIG. 7D is a back face view, and FIG. 7E is a lower face view.

Figure 8:
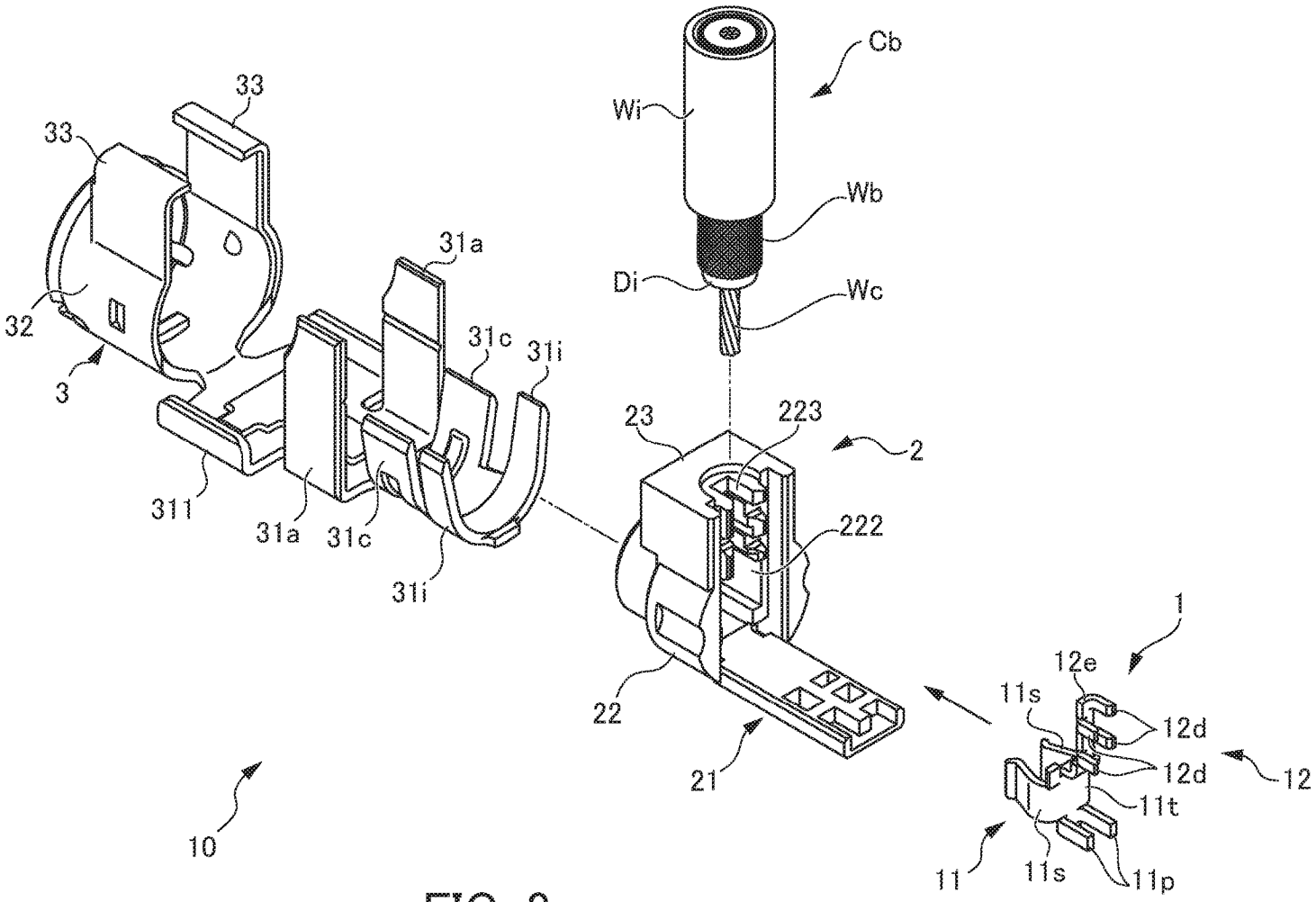
FIG. 8 is an oblique exploded view showing the constitution of the coaxial connector according to this embodiment.

FIG. 8 is an oblique exploded view showing the constitution of the coaxial connector according to this embodiment.

Figure 9:
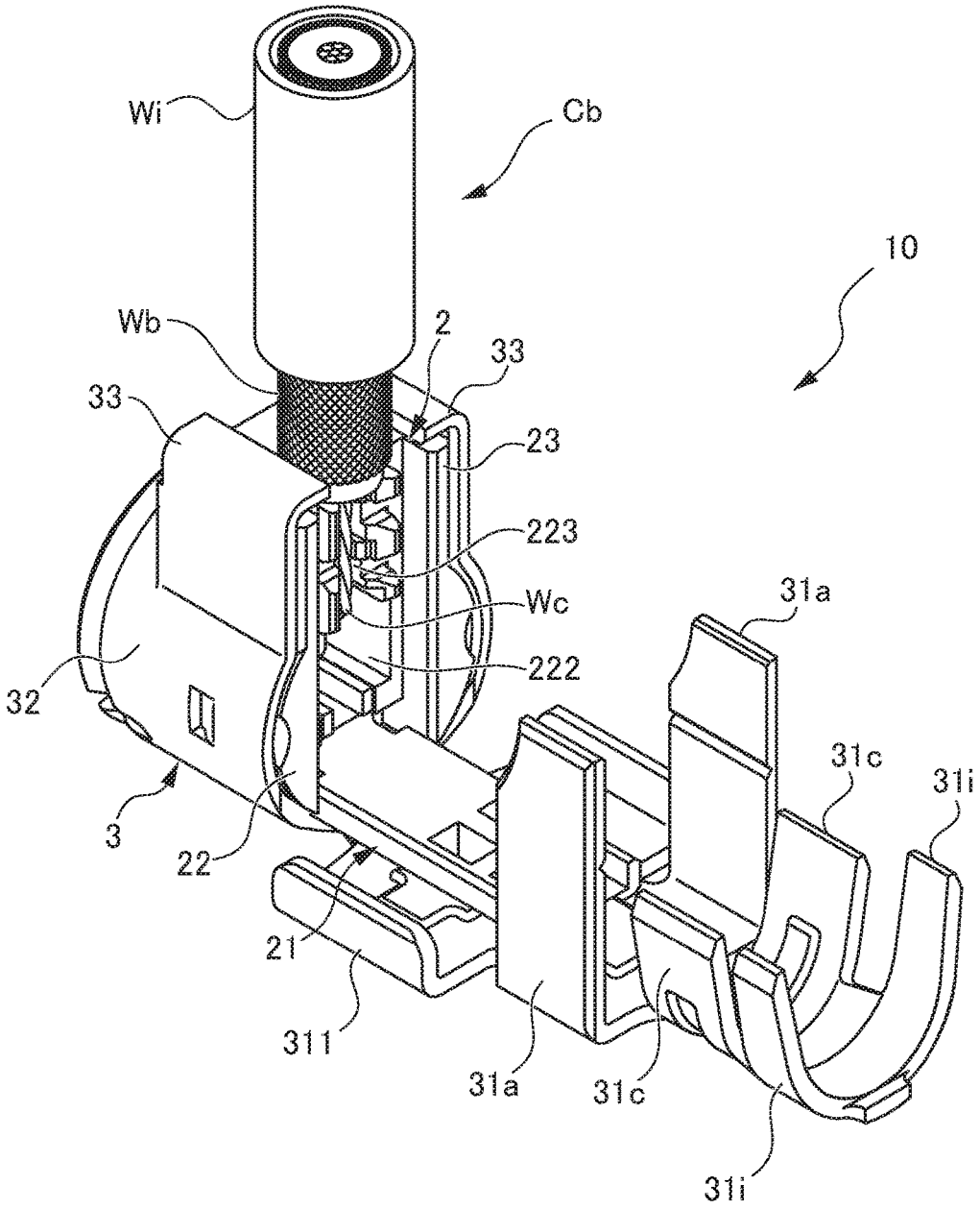
FIG. 9 is an oblique view showing the constitution of the coaxial connector according to this embodiment, and shows a state wherein the terminal of the coaxial cable has been inserted into the housing.

FIG. 9 is an oblique view showing the constitution of the coaxial connector according to this embodiment, and shows a state wherein the terminal of the coaxial cable is inserted into the housing.

Figure 10A:
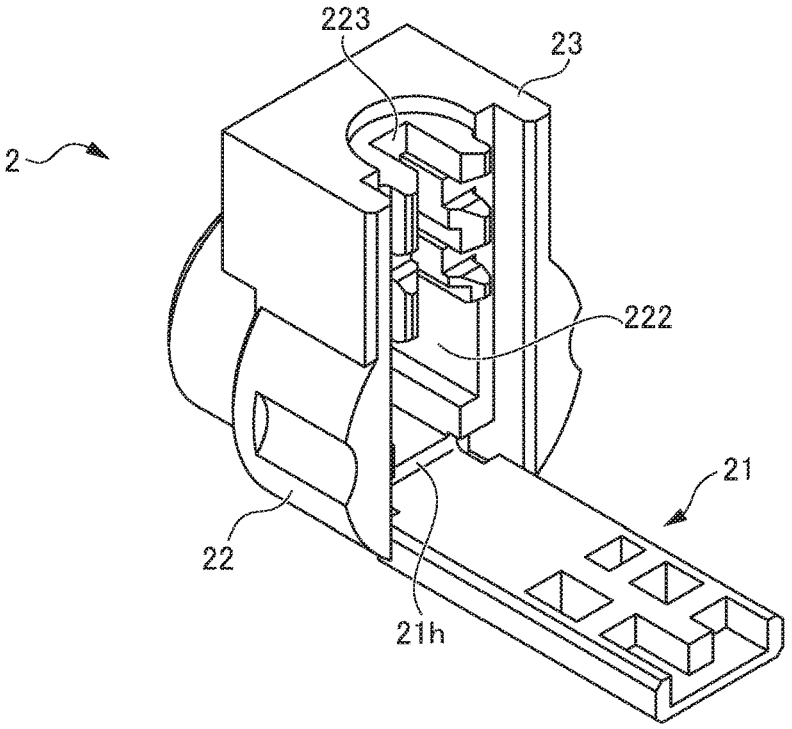
FIGS. 10A and 10B are oblique views showing the constitution of the housing provided at the coaxial connector according to this embodiment.
Figure 10B:
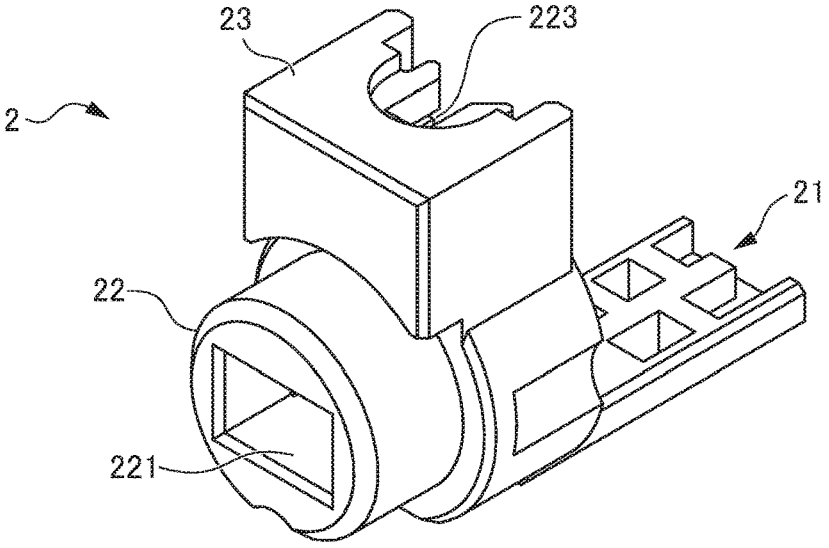

FIGS. 10A and 10B are oblique views showing the constitution of the housing provided at the coaxial connector according to this embodiment, and FIG. 10A shows a state viewed from the rear of the housing, and FIG. 10B shows a state viewed from the front of the housing.

Figure 11D:
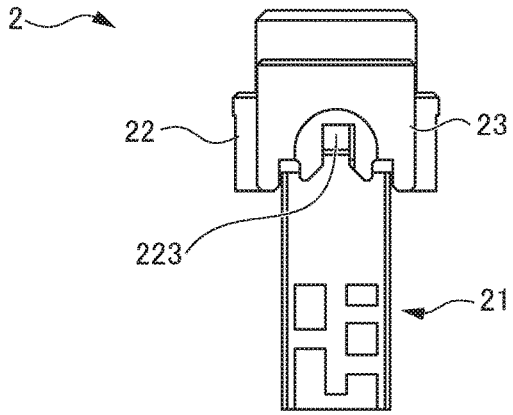
FIGS. 11A to 11E are each views showing the constitution of the housing provided at the connector according to this embodiment.
Figure 11E:
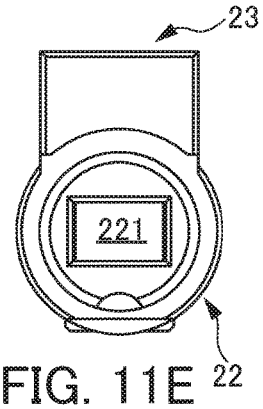
Figure 11A:
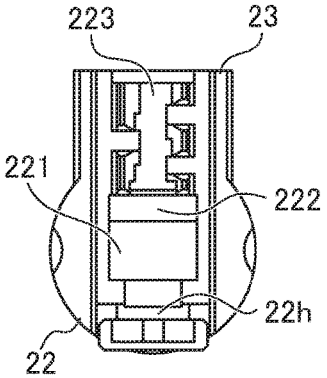
Figure 11C:
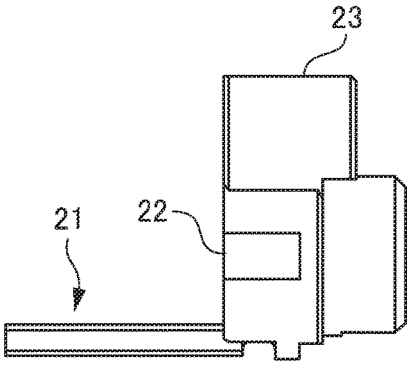
Figure 11B:
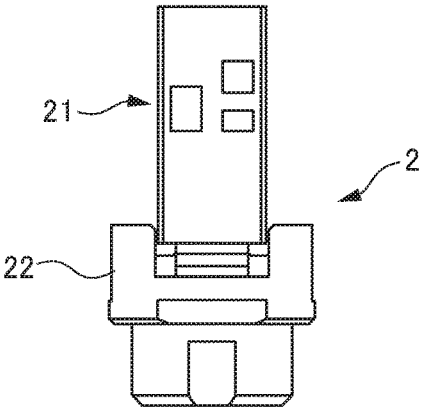

FIGS. 11A to 11E are each views showing the constitution of the housing provided at the coaxial connector to this embodiment, and FIG. 11A is a plan view, FIG. 11B is a front face view, FIG. 11C is a right side face view, FIG. 11D is a lower face view, and FIG. 11E is a back face view.

Figure 12:
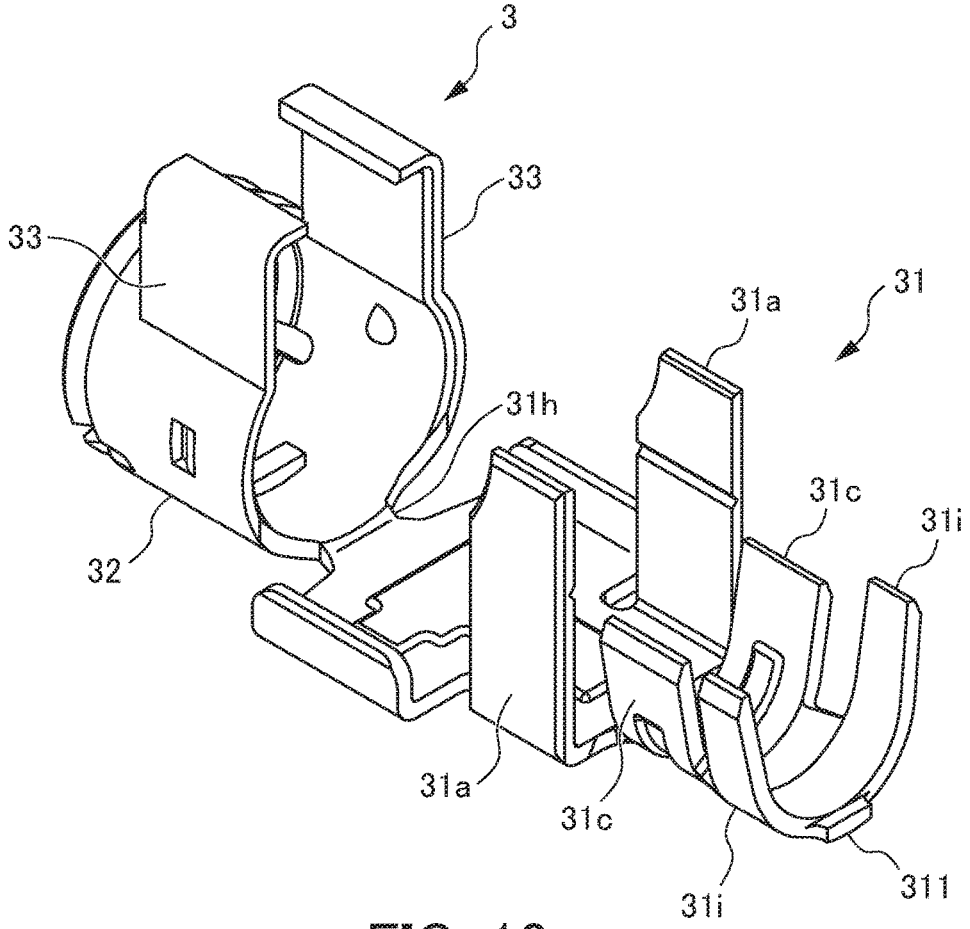
FIG. 12 is an oblique view showing the constitution of the shell provided with the coaxial connector according to this embodiment.

FIG. 12 is an oblique view showing the constitution of the shell provided at the coaxial connector according to this embodiment.

Figure 13D:
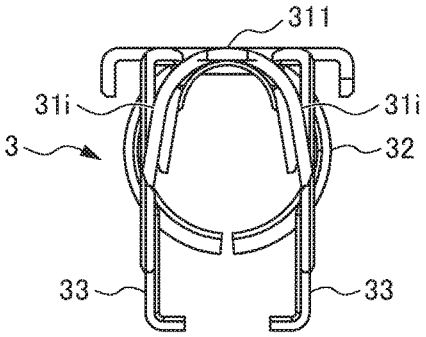
FIGS. 13A to 13E are each views showing the constitution of the shell provided with the coaxial connector according to this embodiment.
Figure 13E:
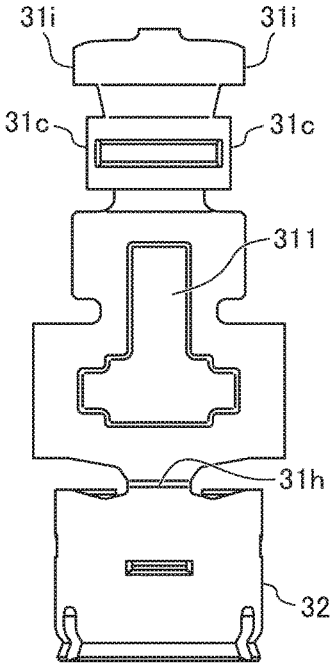
Figure 13A:
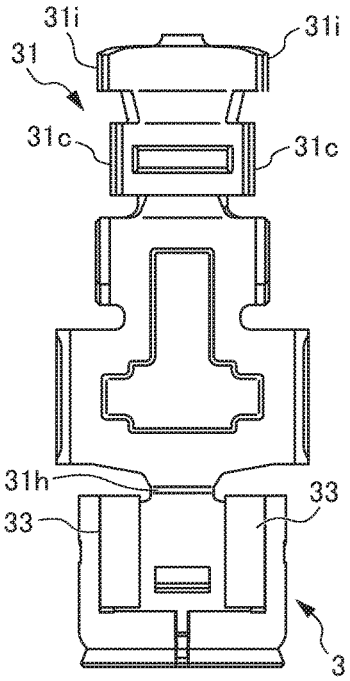
Figure 13C:
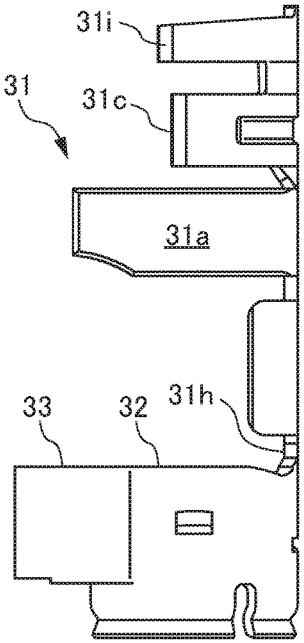
Figure 13B:
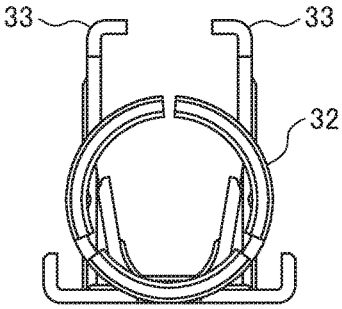

FIGS. 13A to 13E are each views showing the constitution of the shell provided at the coaxial connector according to this embodiment, and FIG. 13A is a plan view, FIG. 13B is a front face view, FIG. 13C is a right side face view, FIG. 13D is a back face view, and FIG. 13E is a lower face view.

Figure 14:
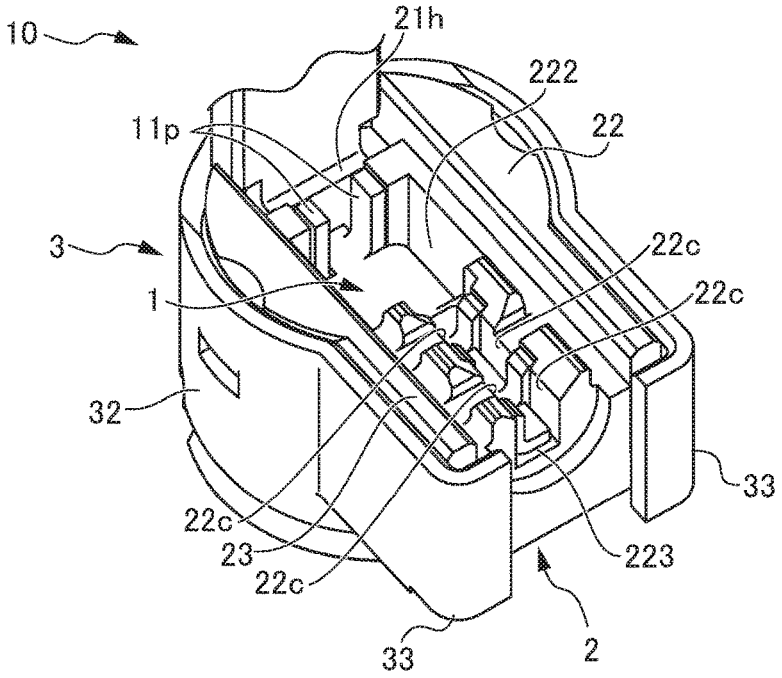
FIG. 14 is an oblique view showing the constitution of the coaxial connector according to this embodiment, and shows an enlargement of the essential portions of the coaxial connector.
Figure 15:
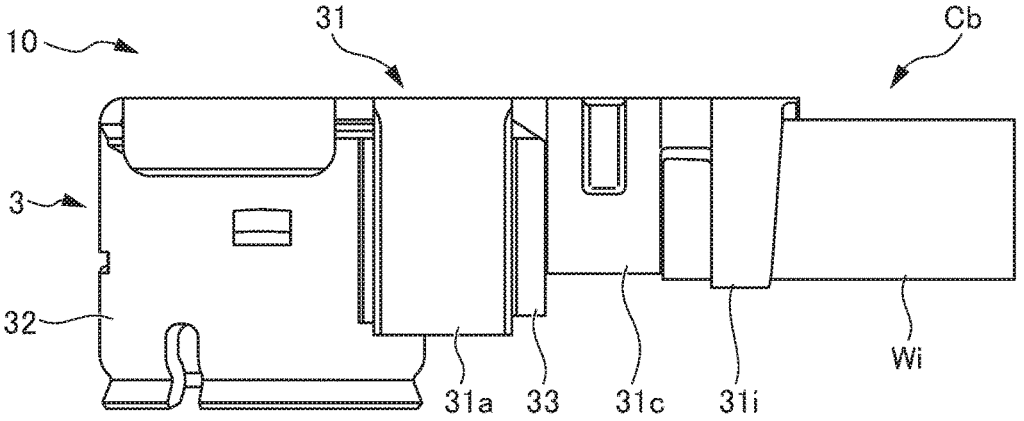
FIG. 15 is a side face view showing the constitution of the coaxial connector according to this embodiment, and shows a state wherein the cable clamp provided at the coaxial connector is folded.

FIG. 14 is an oblique view showing the constitution of the coaxial connector according to this embodiment, and shows an enlargement of the essential portion of the coaxial connector. FIG. 15 is a side face view showing the constitution of the coaxial connector according to this embodiment, and shows a state in which the cable clamp provided with the coaxial connector is folded.

Overall Constitution

With reference to FIG. 1 to FIG. 15, the coaxial connector 10 according to one embodiment of the present invention can constitute a terminal of the coaxial cable Cb. The coaxial connector 10 is provided with a contact 1, a compound housing 2, and an electrically conductive shell 3. The housing 2 has a strip-shaped lid housing 21. The shell 3 has a cable clamp 31.

Referring to FIG. 10A, FIG. 10B or FIG. 11A to FIG. 11E, the housing 2 has a barrel-shaped portion 22 and a square shaped portion 23. The square shaped portion 23 protrudes from one part of the outer periphery of the barrel-shaped portion 22. The barrel-shaped portion 22 has a first accommodating chamber 221 in its central portion (refer to FIG. 10B or FIG. 11E).

With reference to FIG. 7B, the first accommodating chamber 221 has a rectangular opening at one face of the housing 2 such that the mating side contact, not shown in the figure, can be inserted. Further, a pair of contact pieces 11*s*·11*s* are disposed inside the first accommodating chamber 221.

Further, with reference to FIG. 5 to FIG. 7A to FIG. 7E, the housing 2 has, at another face, a rectangularly opened second accommodating chamber 222. One portion of the second accommodating chamber 222 communicates with the first accommodating chamber 221. With reference to FIG. 8, the contact 1 can be inserted in the protruding direction of the pair of contact pieces 11s·11s to the second accommodating chamber 222.

With reference to FIG. 10A, FIG. 10B or FIG. 11A to FIG. 11E, the square shaped portion 23 of the housing 2 has a groove portion 223 notched in a square shape. The groove portion 223 communicates with the second accommodating chamber 222. The extending piece 12e (refer to FIG. 1 to FIG. 4A to FIG. 4D) of the pressure contacting terminal 12 can be inserted into the groove portion 223. Thus, the extending piece 12e can be accommodated in the groove portion 223 (refer to FIG. 5 or FIG. 6).

With reference to FIG. 3 or FIG. 14, in a state wherein the central conductor Wc is inserted between the plurality of pressure contacting pieces 12d separately disposed at the extending piece 12e, the inner walls of the plurality of pressure contacting pieces 12d can alternately contact the central conductor Wc from the outer periphery of the central conductor Wc, and therefore, it is possible to reliably electrically connect the central conductor Wc and the contact 1 without a plurality of strands of the central conductor Wc coming loose.

With reference to FIG. 12 or FIG. 13A to FIG. 13E, the shell 3 has a cylindrical-shaped shell portion 32 and a pair of extended pieces 33·33. The cylindrical-shaped shell portion 32 can accommodate the barrel-shaped portion 22 of the housing 2 from the same direction as the direction in which the pair of contact pieces 11s·11s protrude, towards one face of the cylindrical-shaped shell portion 32 (refer to FIG. 5, FIG. 6, and FIG. 8).

With reference to FIG. 12 or FIG. 13A to 13E, the pair of extended pieces 33·33 extends approximately parallel continuously from a portion of the outer periphery of the cylindrical-shaped shell portion 32. Thus, the square shaped portion 23 of the housing 2 can be accommodated inside the pair of extended pieces 33·33 (refer to FIG. 5 or FIG. 6).

With reference to FIG. 10A, FIG. 10B or FIG. 11A to FIG. 11E, one end of the lid housing 21 is foldably joined to a portion of the barrel-shaped portion 22 by the hinge 21h. Further, the lid housing 21, at its other end side, can open and close the second accommodating chamber 222.

With reference to FIG. 12 or FIG. 13A to FIG. 13E, the cable clamp 31 has a base plate piece 311. One end portion of the base plate piece 311 is foldably joined to a portion of the cylindrical-shaped shell portion 32 by the hinge 31h. Further, the base plate piece 311, at another end side thereof, interlocks with the lid housing 21, and can open and close another face of the shell 3.

The cable clamp 31 comprises a pair of conductor barrels 31c·31c and a pair of insulation grips 31i·31i. The pair of conductor barrels 31c·31c can crimp the external conductor Wb (refer to FIG. 8 or FIG. 15). Thus, the pair of conductor barrels 31c·31c can electrically connect the external conductor Wb and the shell 3.

With reference to FIG. 8 or FIG. 15, the pair of insulation grips 31i·31i can crimp the insulating sheath Wi. Thus, the pair of insulation grips 31i·31i can fix the coaxial connector 10 to the terminal of the coaxial cable Cb.

With reference to FIG. 12 or FIG. 13A to FIG. 13E, the cable clamp 31 further comprises a pair of crimp barrels 31a·31a. The pair of crimp barrels 31a·31a can crimp the square shaped portion 23 via the pair of extended pieces 33·33 (refer to FIG. 9, FIG. 15).

With reference to FIG. 3 or FIG. 14, in a state wherein the central conductor Wc of the coaxial cable Cb is inserted between the plurality of pressure contacting pieces 12d, and the base plate piece 311 of the cable clamp 31 has closed the other face of the shell 3, it is possible to maintain the state wherein the plurality of pressure contacting pieces 12d contact the central conductor Wc.

According to the above described constitution, the coaxial connector 10 provides a contact 1 provided with a connecting terminal 11 having with a pair of contact pieces 11s·11s into which the mating side contact, not shown in the figures, can be inserted, and a pressure contacting terminal 12 having a plurality of pressure contacting pieces 12d alternately arranged in the direction of extension of the extending piece 12e such that one pressure contacting piece 12d does not face another pressure contacting piece 12d separated on the extending piece 12e. Thereby, in a state wherein the central conductor Wc is inserted between the plurality of pressure contacting pieces 12d separately disposed at the extending piece 12e, the plurality of pressure contacting pieces 12d can reliably connect with the central conductor Wc.

Constitution of the Housing and Lid Housing

Next, the constitution of the housing 2 and the lid housing 21 according to the embodiment are explained. With reference to FIG. 10A, FIG. 10B, or FIG. 11A to FIG. 11E, the housing 2 and the lid housing 21 preferably consist of a synthetic resin having insulating properties, and by molding the synthetic resin having insulating properties, it is possible to obtain the housing 2 having the lid housing 21 in the desired shape.

With reference to FIG. 1 to FIG. 4A to 4D and FIG. 5 or FIG. 6, the base portion 11t can be mounted at a bottom face of the second accommodating chamber 222. With reference to FIG. 5 or FIG. 6, in a state wherein the base portion 11t is mounted at the bottom face of the second accommodating chamber 222, the pair of protruding pieces 11p·11p can position the contact 1 in the housing 2.

With reference to FIG. 14, a plurality of recess portions 22c are provided at the groove portion 223. These recess portions 22c are alternately provided at a side wall of the groove portion 223 facing an inner wall of the pressure contacting pieces 12d which the central conductor Wc abuts. Even in the case of a state wherein the central conductor Wc is inserted between the plurality of pressure contacting pieces 12d separately disposed at the extending piece 12e (refer to FIG. 3) and the central conductor Wc meanders, one portion of the central conductor Wc can enter the recess portions 22c.

With reference to FIG. 5 or FIG. 6, by folding the lid housing 21 such that the lead housing 21 faces towards the bottom face of the groove portion 223 (refer to FIG. 15), it is possible to maintain the state wherein the plurality of pressure contacting pieces 12d contact the central conductor Wc.

Constitution of the Shell and the Cable Clamp

Next, the constitution of the shell 3 and the cable clamp 31 according to the embodiment are explained. With reference to FIG. 12 or FIG. 13A to FIG. 13E, for the shell 3 and the cable clamp 31, it is preferable to obtain a shell 3 provided with a cable clamp 31 of the desired shape by forming an expansion plate having conductivity by processing a metal plate having conductivity into a predetermined shape.

Referring to FIG. 12 or FIG. 13, for the shell 3 an expansion plate having conductivity is preferably fold processed to form the cylindrical-shaped shell portion 32 and the pair of extended pieces 33·33. Further, at the cable clamp 31, the pair of conductor barrels 31c·31c and the pair of insulation grips 31i·31i are preferably formed by folding in an opened state. Further, the pair of crimp barrels 31a·31a are preferably formed by folding in a state disposed facing each other.

Operation of the Coaxial Connector

Next, the operation and effects of the coaxial connector 10 according to the present embodiment are explained, while explaining the assembly sequence of the coaxial connector 10 according to the embodiment.

First, with reference to FIG. 5 or FIG. 6 and FIG. 14, the contact 1 is inserted into the housing 2. Next, with reference to FIG. 8, the housing 2 including the contact 1 is inserted into the shell 3 from one face of the shell 3 (refer to FIG. 5 or FIG. 6). In this way, the shell 3 can hold the housing 2 including the contact 1.

Next, with reference to FIG. 8, the central conductor Wc of the coaxial cable Cb is accommodated in the groove portion 223, facing the groove portion 223 of the housing 2 (refer to FIG. 9). In this way, the plurality of pressure contacting pieces 12*d* can contact the central conductor Wc (refer to FIG. 3). Next, as shown in FIG. 9, in a state wherein the cable clamp 31 is standing with respect to the shell 3, the cable clamp 31 is bent towards the other face of the shell 3 (refer to FIG. 15).

Next, with reference to FIG. 15, in a state wherein the base plate piece 311 of the cable clamp 31 has closed the other face of the shell 3, it is possible to maintain the state wherein the plurality of pressure contacting pieces 12*d* are pressure contacting the central conductor Wc. In this way, the contact 1 and the coaxial cable Cb can be reliably mechanically and electrically connected.

Next, with reference to FIG. 9 or FIG. 15, the pair of crimp barrels 31*a*·31*a* crimp the square shaped portion 23 via the pair of extended pieces 33·33, whereby the pressure contacting state of the pressure contacting terminal 12 can be maintained.

Next, with reference to FIG. 9 or FIG. 15, the pair of conductor barrels 31*c*·31*c* crimp the external conductor Wb, whereby the external conductor Wb and the shell 3 can be electrically connected. Next, with reference to FIG. 8 or FIG. 15, the pair of insulation grips 31*i*·31*i* crimp the insulating sheath Wi whereby the terminal of the coaxial cable Cb can be fixed to the coaxial connector 10. Thus, the series of assembly operations is concluded.

With reference to each view of FIG. 1 to FIG. 15, the coaxial connector 10 is provided with the pressure contacting connection type contact 1 provided with the connecting terminal 11 having with a pair of contact pieces 11*s*·11*s* inside which the mating side contact, not shown in the figures, can be inserted, and a pressure contacting terminal 12 having a plurality of pressure contacting pieces 12*d* alternately aligned in the direction of extension of the extending piece 12*e* such that one pressure contacting piece 12*d* does not face another pressure contacting piece 12*d* separated at extending piece 12*e*. In this way, the plurality of pressure contacting pieces 12*d* can reliably contact the central conductor Wc in a state wherein the central conductor Wc is inserted between the plurality of pressure contacting pieces 12*d* separately disposed along the extending piece 12*e*.

With reference to each view of FIG. 5 to FIG. 9, the cable clamp 31 comprises a pair of conductor barrels 31*c*·31*c* which can crimp the external conductor Wb, a pair of insulation grips 31*i*·31*i* which can crimp the insulating sheath Wi, and a pair of crimp barrels 31*a*·31*a* which can crimp the square shaped portion 23 via the pair of extended pieces 33·33, and therefore, the terminal of the coaxial cable Cb and the coaxial connector 10 can be reliably connected.

While preferred embodiments of the present invention have been described and illustrated above, it is to be understood that they are exemplary of the invention and are not to be considered to be limiting. Additions, omissions, substitutions, and other modifications can be made thereto without departing from the spirit or scope of the present invention. Accordingly, the invention is not to be considered to be limited by the foregoing description and is only limited by the scope of the appended claims.

What is claimed is:

1. A pressure contacting connection contact for electrically connecting a coaxial cable and a mating side contact, comprising a connecting terminal to which the mating side contact is connected, and a pressure contacting terminal comprising a strip-shaped extending piece which extends from a base portion side of the connecting terminal and on which a central conductor of the coaxial cable is mounted, and a plurality of pressure contacting pieces which pressure contact the central conductor, protruding fixedly and substantially upright from both sides of the extending piece, intermittently along the both sides, wherein the extending piece extends in a direction crossing a protrusion direction of the connecting terminal via a step portion protruding in an opposite direction of the protrusion direction of the connecting terminal from the base portion side of the connecting terminal, and the level of the step portion rises from the base portion side in the same direction as the upright direction of the plurality of pressure contacting pieces, and wherein the plurality of pressure contacting pieces are configured to be pressure contacted against the central conductor as a whole so that each inner wall portion of the pressure contacting pieces allows contact with the outer periphery of the central conductor while maintaining uprightness from the extending piece.

2. A pressure contacting connection contact according to claim 1, wherein the base portion of the connecting terminal is approximately rectangular, the connecting terminal comprises a pair of contact pieces curvilinearly protruding in an Ω-shape from both sides of the base portion, with a tip portion side opened so as to be able to receive therein the mating side contact, the extending piece extends from one side adjoining both sides of the base portion, and the plurality of pressure contacting pieces of the pressure contacting terminal respectively stand from both sides of the extending piece in an opposite direction of the protrusion direction of the pair of contact pieces so as to be able to receive the central conductor from an outer periphery, and in addition to being disposed intermittently in an extension direction of the extending piece, are arranged such that a pressure contacting piece of one side of the extending piece and a pressure contacting piece of an other side of the extending piece alternate in the extension direction of the extending piece.

3. A pressure contacting connection contact according to claim 1, further comprising a pair of protruding pieces for positioning the connecting terminal in a housing, and these protruding pieces stand in an opposite direction of the protrusion direction of the pair of contact pieces, from both sides of the extending piece extending from an other side adjoining both sides of the base portion.

4. A pressure contacting connection contact according to claim 2, further comprising a pair of protruding pieces for determining a position of the connecting terminal in a housing, and these protruding pieces stand in an opposite direction of the extension direction of the pair of contact pieces, from both sides of the extending piece extending from an other side adjoining both sides of the base portion, wherein the pair of protruding pieces extends substantially straight.

5. A coaxial connector which constitutes a terminal of a coaxial cable having a central conductor, an insulator surrounding this central conductor, an external conductor covering this insulator, and an insulating sheath covering the external conductor, comprising a pressure contacting connection contact according to claim 1, a compound housing having a barrel-shaped portion with one face opened such that a mating side contact is insertable, and having a first accommodating chamber wherein the connecting terminal is disposed, and a square-shaped portion protruding from one portion of an outer periphery of the barrel-shaped portion, and having a second accommodating chamber one part of which communicates with the first accommodating chamber, and which in addition can accommodate the pressure contacting connection contact inserted from a protrusion direction of the connecting terminal at another face, and a conductive shell having a cylindrical-shaped shell portion which is capable of accommodating the barrel-shaped portion from a same direction of as a direction of protrusion of the connecting terminal, towards one face, and a pair of extended pieces extending in an approximately parallel direction continuously from one part of an outer periphery of the cylindrical-shaped shell, wherein the square-shaped portion can be accommodated.

6. A coaxial connector according to claim 5, wherein the square-shaped portion has a groove portion for accommodating the extending piece of the pressure contacting connection contact communicating with the second accommodating chamber, and the groove portion comprises a plurality of recess portions provided alternately at a side wall of the groove portion facing an inner wall of the pressure contacting piece which the central conductor abuts, into which a part of the central conductor can enter.

7. A coaxial connector according to claim 5, wherein the housing comprises a strip-shaped lid housing with one end side bendably joined with one portion of the barrel-shaped portion, and an other end side being able to open and close the second accommodating chamber and the groove portion, and the shell comprises a cable clamp having a base plate piece with one end side bendably joined with one portion of the cylindrical-shaped shell portion, and an other end side which interlocks with the lid housing, and which can open and close an other face of the shell.

8. A coaxial connector according to claim 7, wherein the cable clamp comprises a pair of conductor barrels which can crimp the external conductor, a pair of insulation crimps which can crimp the insulating sheath, and a pair of crimp barrels which can crimp the square-shaped portion via the pair of extended pieces.

9. A pressure contacting connection contact for electrically connecting a coaxial cable and a mating side contact, comprising a connecting terminal having a base portion formed with an approximately rectangular shape, and a pair of contact pieces curvilinearly protruding in an Ω-shape from both sides of the base portion, with a tip portion side opened so as to be able to receive therein the mating side contact, and a pressure contacting terminal having a strip-shaped extending piece extending from one side adjoining both sides of the base portion, on which the central conductor of the coaxial cable can be mounted, and a plurality of pressure contacting pieces fixedly and substantially upright from both sides of the extending piece in an opposite direction of the protrusion direction of the pair of contact pieces and disposed so as to be able to receive the central conductor from an outer periphery, wherein the plurality of pressure contacting pieces, in addition to being disposed intermittently in an extension direction of the extending piece, are arranged such that a pressure contacting piece of one side of the extending piece and a pressure contacting piece of an other side of the extending piece alternate in the extension direction of the extending piece, and wherein the plurality of pressure contacting pieces are configured to be pressure contacted against the central conductor as a whole so that each inner wall portion of the pressure contacting pieces allows contact with the outer periphery of the central conductor while maintaining uprightness from the extending piece.

10. A pressure contacting connection contact according to claim 9, wherein the connecting terminal further comprises a pair of protruding pieces for positioning in a housing, and the pair of protruding pieces stand in an opposite direction of the protrusion direction of the pair of contact pieces, from both sides of the extending piece extending from an other side adjoining both sides of the base portion, wherein the pair of protruding pieces extends substantially straight.

11. A pressure contacting connection contact according to claim 9, wherein the extending piece extends in a direction crossing the protrusion direction of the connecting terminal via a step portion protruding in an opposite direction of the protrusion direction of the connecting terminal from the base portion side of the connecting terminal, and the level of the step portion rises from the base portion side in the same direction as the upright direction of the plurality of pressure contact pieces.

12. A pressure contacting connection contact for electrically connecting a coaxial cable and a mating side contact, comprising a connecting terminal to which the mating side contact is connected, and a pressure contacting terminal comprising a strip-shaped extending piece which extends from a base portion side of the connecting terminal and on which a central conductor of the coaxial cable is mounted, and a plurality of pressure contacting pieces which pressure contact the central conductor, protruding fixedly and substantially upright from both sides of the extending piece, intermittently along the both sides, wherein the plurality of pressure contacting pieces are configured to be pressure contacted against the central conductor as a whole so that each inner wall portion of the pressure contacting pieces allows contact with the outer periphery of the central conductor while maintaining uprightness from the extending piece.

13. A pressure contacting connection contact according to claim 12, wherein the extending piece extends in a direction crossing the protrusion direction of the connecting terminal via a step portion protruding in an opposite direction of the protrusion direction of the connecting terminal from the base portion side of the connecting terminal, and the level of the step portion rises from the base portion side in the same direction as the upright direction of the plurality of pressure contact pieces.

14. A pressure contacting connection contact according to claim 12, further comprising a pair of protruding pieces for determining a position of the connecting terminal in a housing, and these protruding pieces stand in an opposite direction of the extension direction of the pair of contact pieces, from both sides of the extending piece extending from an other side adjoining both sides of the base portion, wherein the pair of protruding pieces extends substantially straight.

* * * * *